United States Patent [19]

Wagner

[11] 4,446,510

[45] May 1, 1984

[54] REFLECTOR SEALING APPARATUS

[75] Inventor: George K. Wagner, Horn Lake, Miss.

[73] Assignee: International Telephone and Telegraph Corporation, New York, N.Y.

[21] Appl. No.: 449,237

[22] Filed: Dec. 13, 1982

[51] Int. Cl.[3] ..... F21V 29/00

[52] U.S. Cl. ..... 362/267; 362/217; 362/306; 362/307; 362/362; 362/376

[58] Field of Search ..... 362/267, 306, 307, 362, 362/376, 217

[56] References Cited

U.S. PATENT DOCUMENTS 3,919,542 11/1975 Castic ..... 362/267

4,059,753 11/1977 Tart et al. ..... 362/267

*Primary Examiner*—Stephen J. Lechert, Jr.

*Attorney, Agent, or Firm*—James B. Raden; Marvin M. Chaban

[57] ABSTRACT

Apparatus for sealing the space between the outside of the socket and the reflector of an outdoor luminaire of the type having its lamp on a substantially horizontal axis. The reflector has an elongated oblong opening through which the socket projects, the oblong shape of the opening enabling setting the mounting height of the cylindrical socket. The space between the socket and reflector must be sealed to prevent insects, dust and dirt from entering the reflector. A sealing plate with an opening larger than the area of the socket circular section resiliently grips the reflector and compresses a gasket liner peripherally enclosing the reflector opening. Adhered to the plate is a second gasket which yieldably engages the outer wall of the socket with an interference fit and completes the sealing action. The resilient gripping of the reflector by the plate is accomplished by two stepped ears on the sealing plate. The spacing between the step of the ears is less than the length of the oblong opening enabling the plate to be placed on the reflector with the tabs extending through the opening so that the plate may be rotated 90° to engage the tabs to the reflector across the width of the opening compressing the liner.

5 Claims, 7 Drawing Figures

REFLECTOR SEALING APPARATUS

BACKGROUND OF THE INVENTION

It is generally known that the area between a multiple position socket and a fixed position reflector should be sealed to prevent the entry of dust and insects into the reflector. In the usual approach, a rectangular sheet of adhesive backed silicone gasket is mounted over the elongated clearance slot or opening in the reflector. An aperture in the gasket smaller in area that the area of the socket is stretched or spread to allow the socket to pass through the gasket. If the position of the socket in the elongated opening is altered, the gasket must stretch to enable the gasket to maintain its seal between the socket and reflector.

The seal must enable the socket to be adjusted within the length of the opening while still maintaining the seal between socket and reflector. The material itself and the adhesive must withstand the elevated temperatures within the luminaire to maintain the sealing relationship.

SUMMARY OF THE INVENTION

The invention is directed to construction features of an outdoor luminaire and more particularly to improved apparatus for sealing the area between the body of a socket which is adjustable relative to the reflector and the opening in the reflector through which the socket projects. The sealing arrangement must be sufficient to prevent large particulate matter and insects from entering the reflector cavity adjacent the socket.

To produce a seal which properly seals the area regardless of the position of socket within the reflector, a sealing gasket with interference fit relative to the socket body is used. The gasket is secured on a plate which grips the reflector adjacent the socket opening of the reflector. To complete the seal, the periphery of reflector opening is sheathed with a liner strip of fortrel felt which is adhered to the reflector covering the periphery. The fortrel felt is compressed by the gasket mounting plate such that the plate and sheath seal the periphery of the opening and the gasket seals the plate to the socket body.

This form of sealing arrangement may be readily mounted on the reflector and socket regardless of the position of the socket within the elongated opening in the reflector, and regardless of the angle of inclination of the socket wall of the reflector.

The plate has stepped ears for gripping the reflector and compressing the liner. The spacing between ears is less than the length of the oblong opening and greater than the "across—the flats" dimension of the opening. The plate is rotated to align the ears with the opening length to position the ears with the thickness of reflector in the step. The plate is rotated 90° to capture the reflector thickness between the plate and car step to mount the plate on the reflector.

DETAILED DESCRIPTION

Figure 1:
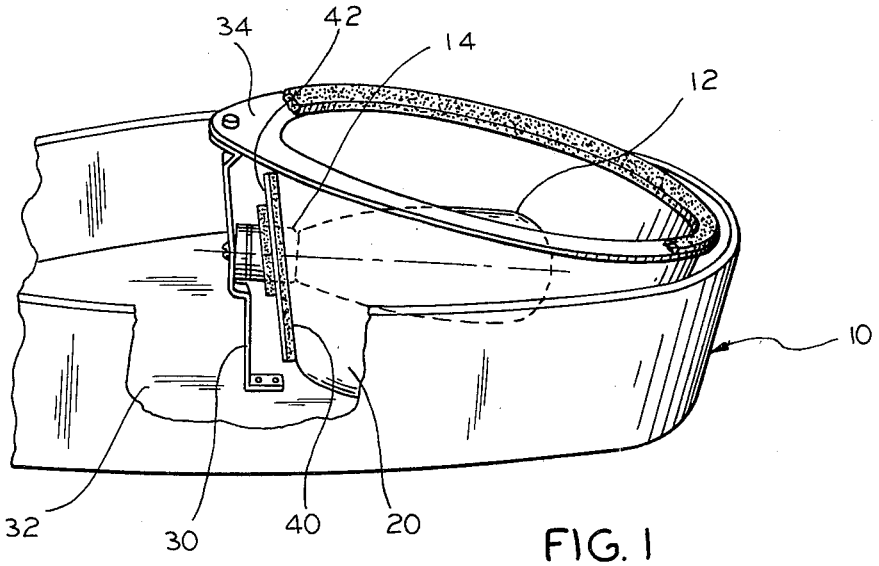
FIG. 1 is a perspective view of the interior of an outdoor luminaire, inverted from its mounted position and partially broken away to show the socket mounting area.
Figure 3:
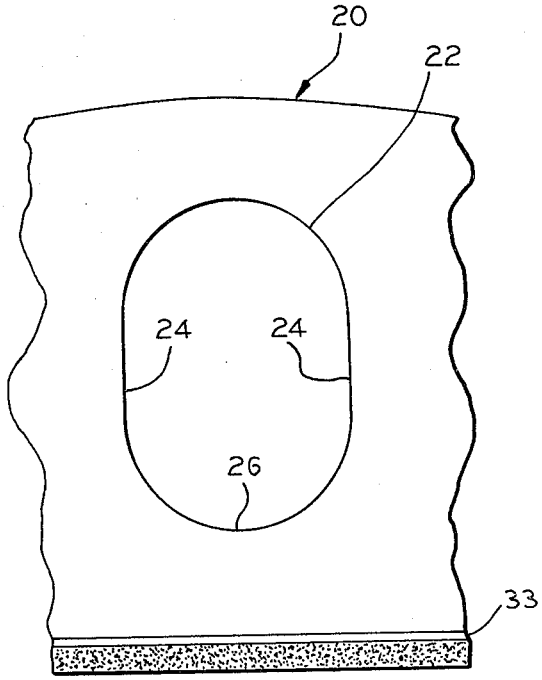
FIG. 3 is an end view in elevation of a portion of the reflector of FIGS. 1 and 2 showing the socket mounting opening.

FIG. 1 shows an outdoor luminaire 10 with the lens or refractor detached and with the luminaire inverted from its mounting condition. The luminaire 10 is generally of the type shown in U.S. Pat. No. 4,200,905 issued Apr. 29, 1980 to B. L. Shelby et at. In such a luminaire, the lamp 12 is mounted in a generally cylindrical socket 14 with the lamp axis generally horizontal. The socket mounting is external to the ovate reflector 16 with the lamp extending into the reflector to enable reflection of the light generated by the light. The socket extends through an oblong opening 22 in the wall of the reflector. The opening 22 has parallel sides 24 extending generally vertically, leading to arcuate upper and lower ends 26. The distance between the parallel sides 24 is greater than the diameter of the lamp socket to provide a clearance for the socket in passing into the reflector. A suitable opening 22 is shown in FIG. 3.

The socket is secured to an intermediate step 31 in a socket mounting bracket 30, the bracket being secured to the luminaire housing 32 at one end and to a rim 34 of the reflector at its other end. At the step 31, the socket is secured by a fastening screw mating with a receiving member such as a nut or fastener in the rear wall 38 of the socket.

The oblong shape of the reflector opening 22 allows fixed position reflector to be used with lamps adapted to mount at settable heights in the reflector.

With the socket mounting and wires outside the reflector and the socket body 14 protruding through the opening, the opening must be sealed against the entry of dust, dirt and insects into the reflector concavity. This sealing is provided by the combination of a liner 40 for the opening 22, a sealing plate 42 and a sealing backing strip 44 for the plate.

Figure 4:
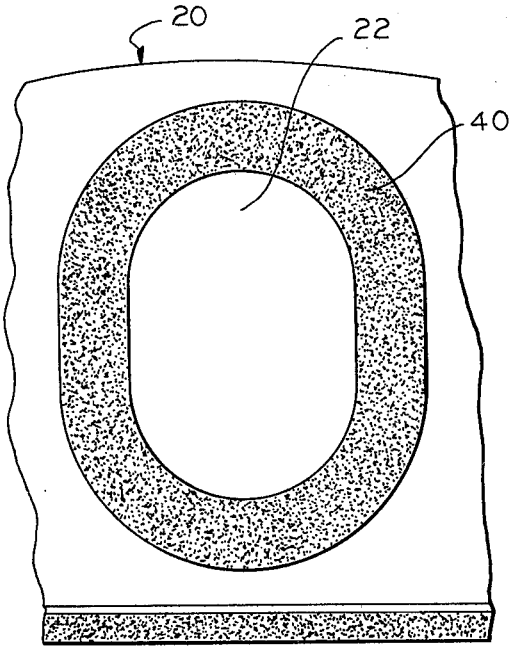
FIG. 4 is an end view similar to FIG. 3 showing the opening with edge gasketing applied.

The sealing liner 40 for the oblong opening is formed of a single length of strip gasket material such as Fortrel felt sufficiently long to cover the periphery of the opening. One face of the line has adhesive backing to adhere to the walls of the reflector and line the opening periphery in the manner of a grommet. The liner is applied with the center of width of the liner along the periphery of the opening. The liner is aligned in a single continuous run about the opening perimeter. The lateral edges of the liner are folded over against the reflector and as mentioned adhered to the reflector on both surfaces—the inside reflective surface and the outside surface to completely line the periphery of the opening, as seen in FIG. 4.

Figure 6:
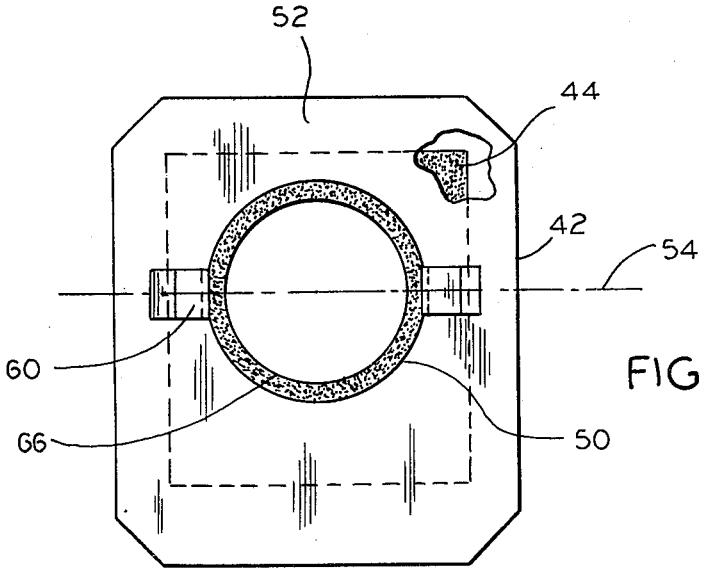
FIG. 6 is a plan view of the mounting plate of FIG. 5.
Figure 7:
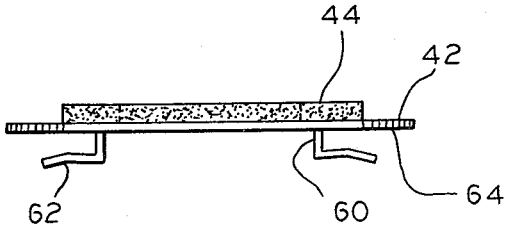
FIG. 7 is a side view in elevation of the mounting plate of FIG. 6.

The sealing plate 42 is shown in detail in FIGS. 6 and 7. The plate is formed of a generally rectangular, thin sheet of aluminum or the like which may be 0.032" in thickness. Alternatively, the plate may be molded of a suitable high temperature plastic capable of withstanding temperatures in the range of 155° C.

As seen in FIG. 6, the sealing plate 42 is generally rectangular and has its corners trimmed to remove the sharp edges. The plate 42 has a central circular opening 50 with a clearance tolerance to the lamp socket. The opening 50 is circular with diameter of the opening greater than the diameter of the socket. The opening is centered transversely but is closer to one vertical end, the upper end 52 as viewed in FIG. 6.

Adjacent the sides of the opening 50 and along the horizontal centerline 54 are two mounting ears 60, the ears being stepped normal to the surface of the plate and terminating in ends 62 extending parallel to the front face 64 of the sealing plate. The free ends 62 of the ears are inclined at a slight angle from a plane parallel to the face 64 of the sealing plate 50 to enable entry of the reflector into the step of the ears. Adhered to the rear face of the sealing plate is the backing strip or gasket 44, a rectangle of felt gasket material having an adhesive backing for the adherence to the plate. The felt gasket has a circular opening 66 sized for interference fit with the cylindrical socket body 14. The opening 66 in the gasket is positioned generally concentrically with the sealing plate opening 50 and covering a ring inward of the opening periphery. The gasket may be approximately $\frac{1}{4}''$ thick and is adhered to the sealing plate face opposite the face 64 which bears the mounting ears 60.

Figure 2:
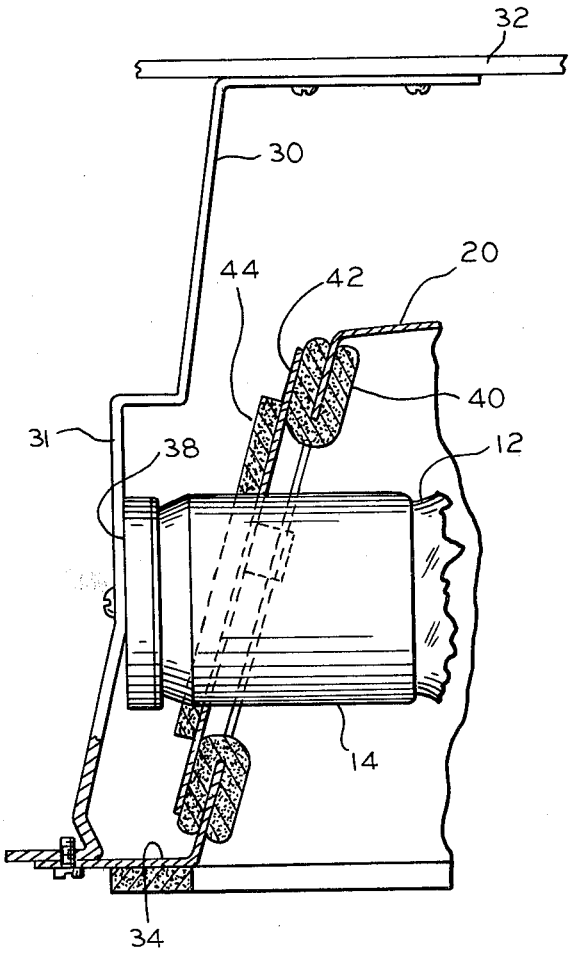
FIG. 2 is a side view in elevation of the socket mounting area of FIG. 1 inverted from the showing of FIG. 1.
Figure 5:
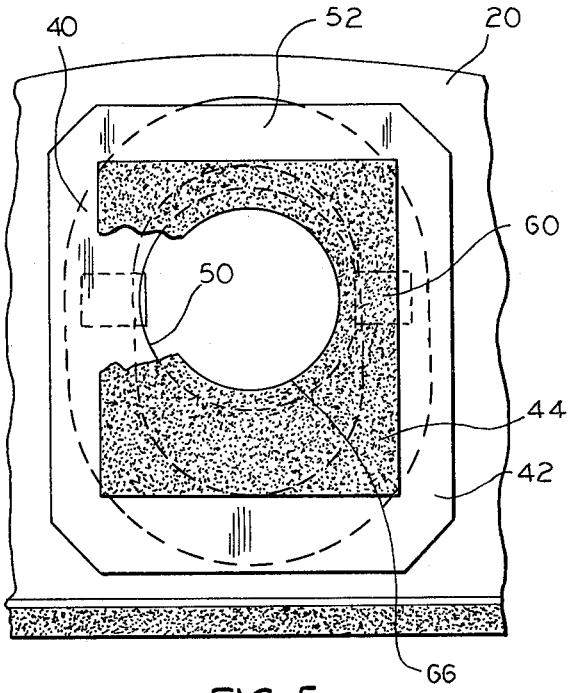
FIG. 5 is an end view similar to FIGS. 3 and 4 showing the mounting plate assembled to the opening.

Before mounting the socket 14 on the bracket 30, the reflector oblong opening 22 is lined with the felt liner 40, as described. The socket 14 has the sealing plate 42 mounted thereon with the socket 14 loosely fitted in the gasket opening 66 with the ears 60 aligned vertically in the length of the oblong opening. The socket is secured in place with the screw. The sealing plate 42 is positioned so that the mounting ears 60 of the plate 42 are aligned with the arcuate ends 26 of the oblong reflector opening 22. The sealing plate 42 is squeezed against the liner and the plate 42 is rotated 90° to capture the reflector wall and liner 40 between the front face 64 of the plate 42 and the free ends of the mounting ears 60. The liner 40 is compressed by the front face 64 of the plate 42 with the ears holding the plate on the reflector as shown in FIGS. 2 and 5.

The plate 42 compresses the liner 40 and seals the periphery of the reflector opening 22. The spacing between the socket and plate opening is sealed by the backing gasket 44 due to its interference fit around the socket cylindrical body 14.

The sealing plate rides or floats on the reflector and may be secured on the reflector regardless of the mounting height of the socket relative to the luminaire housing.

What is claimed is:

1. In an outdoor luminaire having a reflector with an elongated opening in the reflector adjacent one end thereof for receiving a generally cylindrical socket therethrough, sealing structure for said opening to seal the space between the socket and the reflector, said structure including a first grommet-like gasket enclosing the periphery of said opening, a sealing plate with its area greater than said opening, an aperture in said plate for receiving the socket therethrough with a clearance fit, said plate being otherwise imperforate, a gasket member affixed to said plate, said gasket member having a passage therethrough to receive said socket with a negative allowance fit, and said plate including a pair of spaced apart tabs for resiliently engaging said reflector adjacent said opening to grip and compress the gasket between the plate and the reflector whereby to cover and seal said opening with said gasket member externally of the socket.

2. In a reflector as claimed in claim 1, wherein said tabs comprise members stepped outwardly from their mounting to the plate adjacent said aperture, said tabs engaging the interior wall of the reflector enabling sliding movement of the plate in the direction of elongation of the opening.

3. In a reflector as claimed in claim 2, in which said tabs are inherently resilient with the step of each tab compressing said gasket.

4. An outdoor luminaire having a single position reflector with an elongated oblong opening in the reflector adjacent one end thereof for receiving a generally cylindrical, multiple position socket therethrough with its axis generally horizontal, said luminaire including sealing said opening to seal the space between the socket and the reflector, said means including a liner sealing the periphery of said opening, said liner comprising a strip of gasket material adhered to the reflector about the entire periphery of the opening, a sealing plate with its area greater than said opening, an aperture in said plate for receiving the socket therethrough with a clearance fit, a gasket member affixed to said plate said gasket having a passage therethrough to receive said socket with a negative allowance fit, the body of said gasket covering the aperture with the socket in said passage, and said plate including a pair of spaced apart stepped ears for resiliently engaging said reflector adjacent said opening to grip and compress the liner between the plate and the reflector whereby to cover and seal said opening externally of the socket.

5. In a reflector as claimed in claim 4, wherein said ears comprise members stepped outwardly from the plate on each side of the aperture, said ears adapted to engage the interior wall of the reflector enabling rotative movement of the plate in the direction of elongation of the opening.

* * * * *